United States Patent [19]

Blank

[11] Patent Number: 4,508,261

[45] Date of Patent: Apr. 2, 1985

[54] HOT WATER CONTROL AND MANAGEMENT SYSTEM

[76] Inventor: Gerald Blank, 702 Forward St., La Jolla, Calif. 92037

[21] Appl. No.: 343,532

[22] Filed: Jan. 28, 1982

[51] Int. Cl.[3] ..... F23N 1/08; F24H 1/00

[52] U.S. Cl. ..... 236/20 R; 236/46 R; 219/334; 126/374

[58] Field of Search ..... 165/12; 236/46 R, 94, 236/20 R; 126/374, 351; 431/14, 18; 219/334

[56] References Cited

U.S. PATENT DOCUMENTS

| | | | |
|---|---|---|---|
| 3,203,258 | 8/1965 | Grayson | 74/3.5 |
| 3,599,863 | 8/1971 | Pinckaers | 236/46 |
| 3,929,284 | 12/1975 | Prewarski et al. | 236/46 |
| 3,989,928 | 11/1976 | Scragg et al. | 236/46 R |
| 4,110,632 | 8/1978 | Wyland | 307/117 |
| 4,174,807 | 11/1979 | Smith et al. | 236/47 |
| 4,206,872 | 6/1980 | Levine | 236/46 |
| 4,308,991 | 1/1982 | Peinetti et al. | 236/46 R |

*Primary Examiner*—William E. Wayner

*Attorney, Agent, or Firm*—Baker, Maxham, Callan & Jester

[57] ABSTRACT

A hot water control system for providing necessary hot water to a structure at optimum energy saving conditions includes a programmable control system for selectively programming preselected quantities of hot water at preselected time periods over a given interval of time and includes a mode selector for selectively overriding the control system to permit adjustment of the system to meet unscheduled changes in demand. The system includes mode selectors for selecting the programmed mode wherein predetermined supplies of hot water are available at predetermined time periods over a seven day period or the like and other modes may be selected such as pilot only operation, normal service wherein the water heater operates in its normal manner, pilot off or complete shutdown of the system for periods of time such as for vacation and the like.

19 Claims, 3 Drawing Figures

WATER HEATER
84
ELECTRIC HEATER
86
HEATER CONTROL
88

HOT WATER
10
COLD WATER
12
WATER HEATER
32
34
36
BURNER

CLOCK AND CALANDER
20
DISPLAY
DATA DISPLAY
26
PRINTER
28
TEMPERATURE SENSE
30
CONDITION INDICATOR
24
PILOT AND BURNER CONTROL
14
BEEPER
90
PROGRAMMER
18
CENTRAL PROCESSING UNIT
16
MODE SELECTOR
22

HOT WATER CONTROL AND MANAGEMENT SYSTEM

BACKGROUND OF THE INVENTION

The present invention relates to a system for controlling the supply of hot water and pertains particularly to a multiple mode programmable hot water system.

The abundance of low cost sources of energy and fuel in the past has resulted in the development of wasteful habits and energy utilizing sytems. For example, most structures in the United States have hot water systems that provide an almost unlimited instantaneous supply of hot water on demand. Such systems utilize an enormous amount of energy in maintaining the supply of hot water at times when such supply is not required. This results in enormous waste of fuel and energy.

The typical hot water heater in use today is usually either gas or electrical and operates to maintain the hot water in the hot water tank at a predetermined minimum temperature at all times throughout the day and night. Such systems also in the past have been rated on a recovery basis, meaning the ability to maintain or quickly recover the maximum supply of water. This results in an unnecessary waste of energy.

While it is difficult to program the hot water system to provide hot water only at times needed, I have developed a system that overcomes most of the problems associated therewith and provides not only maximum savings and energy, but maximum convenience to the user. This system is based on a number of factors including the realization that the typical water heater today utilizes a pilot light that under normal circumstances wherein the heater is located within a structure provides and maintains the water in the water heater tank at a temperature that is capable of supplying a major part of the demands for hot water within. The usual hot water heater, however, that is gas operated, typically maintains the water temperature in the tank at a level that may be higher than necessary for normal use and in order to accomplish this frequently turns on during the day to maintain the predetermined level of temperature.

The typical electrical hot water heater operates in a somewhat similar manner with some units having heaters that operate full on and full off with others having heaters that function at high and low states.

I have devised a system that is capable of controlling either the gas powered hot water heater or the electrically powered hot water heater and provides maximum convenience as well as maximum savings in energy and fuel.

SUMMARY AND OBJECTS OF THE INVENTION

It is the primary object of the present invention to provide an improved hot water control system with consequent energy savings.

In accordance with the primary aspect of the present invention, a hot water control system includes a programmable control system with means for programming selected periods of predetermined supply of hot water at preselected periods over a predetermined time interval with means for selectively overriding the programmed control for providing alternate normal service, pilot only operation or the like.

BRIEF DESCRIPTION OF THE DRAWINGS

The above and other objects and advantages of the present invention will become apparent from the following description when read in conjunction with the drawings wherein.

DETAILED DESCRIPTION OF A PREFERRED EMBODIMENT

The system of the present invention is designed to provide flexibility in a hot water control system and to permit programming for maximum savings of fuel. The system is a control system primarily for utilization with existing hot water heaters that typically exist in the average structure today. These hot water heaters are either gas-fired or electrically operated and the present system is adapted to function with either, with minor modifications.

Figures 1, 2:
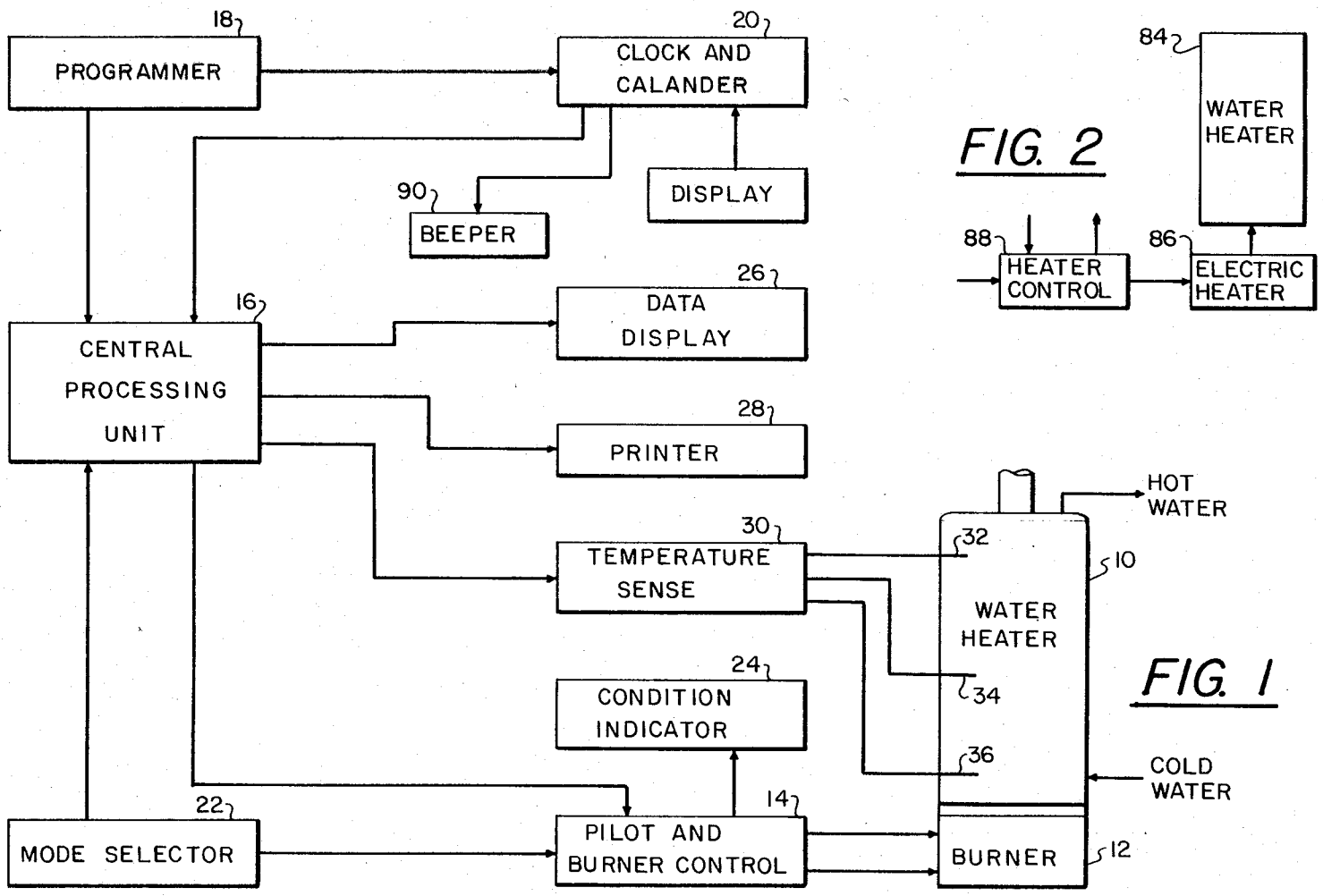
FIG. 1 is a schematic block diagram of the system of the present invention.
FIG. 2 is a schematic block diagram of an alternate heater.

Turning to FIG. 1 of the drawings, a block diagram of the system is illustrated in conjunction with a conventional gas-fired hot water heater. More particularly, a hot water heater 10 of a conventional design includes a gas burner 12 which includes a pilot light and a pilot and burner control 14 which includes a thermostatic coupling means for sensing the temperature of the water within the tank 10. The present system is based on the realization that a conventional hot water heater of a 30 gallon or 40 gallon capacity maintains the water in the tank at a temperature that will supply sufficient water for much of the needs of the typical household or office building without the necessity of the burner being activated. This can result in the savings of considerable amount of energy over a period of a month or more.

The present system provides override control in its programmed mode to the existing pilot light and burner control such that only the pilot light is operative until a predetermined unusual demand for water is required.

Turning particularly to the system, the heart of the system is a central processing unit 16 having the capability of making certain calculations and responding to date and time input and may include clock and calender components therein. Such central processing units are available on chips from a number of manufacturers, such as National Semiconductor of Santa Clara, California, or Texas Instruments, Inc. of Dallas, Texas. A programmer 18 provides programming for the central processing unit and for a clock calendar unit 20 which is also, functionally, in communication wth the CPU. The central processing unit is tied in to control the pilot light and the burner control by, in certain modes overriding the normal burner control to provide the selected supply of hot water and then switching to pilot only to maintain that supply. A mode selector 22 enables the user to select a certain mode of operation as he sees fit or desires.

This permits the user to program certain conditions of the system such as under the control of the central processing unit, pilot only, normal service, pilot off and include a restart control. A condition indicator 24 for indicating the operative condition of on or off of the pilot light and burner is preferably provided. The control system as described herein is preferably located in a central convenient and readily accessible location, such as in a kitchen or in a hallway adjacent the main bathroom. This puts the control system remote from the water heater itself which is normally located either in a basement, a garage, a utility room, or closet area not normally readily accessible. The control system is preferably highly visible such that it will easily remind the user of the existence thereof and the need for monitoring the system.

The central processing unit may be programmed by the programmer to control the supply of hot water at particular times during particular days of the week. The central processing unit also senses the temperature within the heater, the amount of fuel burned and the amount of water used and thereby can compute and display by means of a data display 26 such information as the hot water available in minutes or gallons as desired and the tank temperature at certan levels within the tank. The central processing unit will be programmed with the water heater tank or reservoir volume and with this information can calculate and display the cost per gallon of hot water or per day, week, or month, as desired. The system may also be provided with a printer 28 such as is typically available on the market today for providing hard copy by printing certain information as desired such as the cost per unit of the hot water used, the cost at certain time intervals, the availability and demand of the water, etc. This permits the user to fine tune the system to provide optimum efficiency and use of energy. For example, if more hot water was available than used at certain programmed periods, the supply could be cut to the time demand, etc.

The hot water heater is equipped with a temperature sensor 30 with probes at the top 32, the center 34, and the bottom 36 for sensing the temperature at these levels within the tank. Since hot water rises, this information can be utilized to provide the necessary information for the CPU to calculate the available water. The CPU can then adjust the available water as the program demand requires.

Turning to FIG. 2, a schematic illustration of a setup for an electrically heated water heater is illustrated. With such a system low heat setting is established for the heating element to replace the pilot only function of the gas heater, otherwise the entire system is the same. More particularly a water heater 40 is provided with a heating element 42 that is controlled by the heating element control 44. The heating control is controlled by the central processing unit as in the previous embodiment, with the same general data and control signals being sent and received between the respective components of the system.

Figure 3:
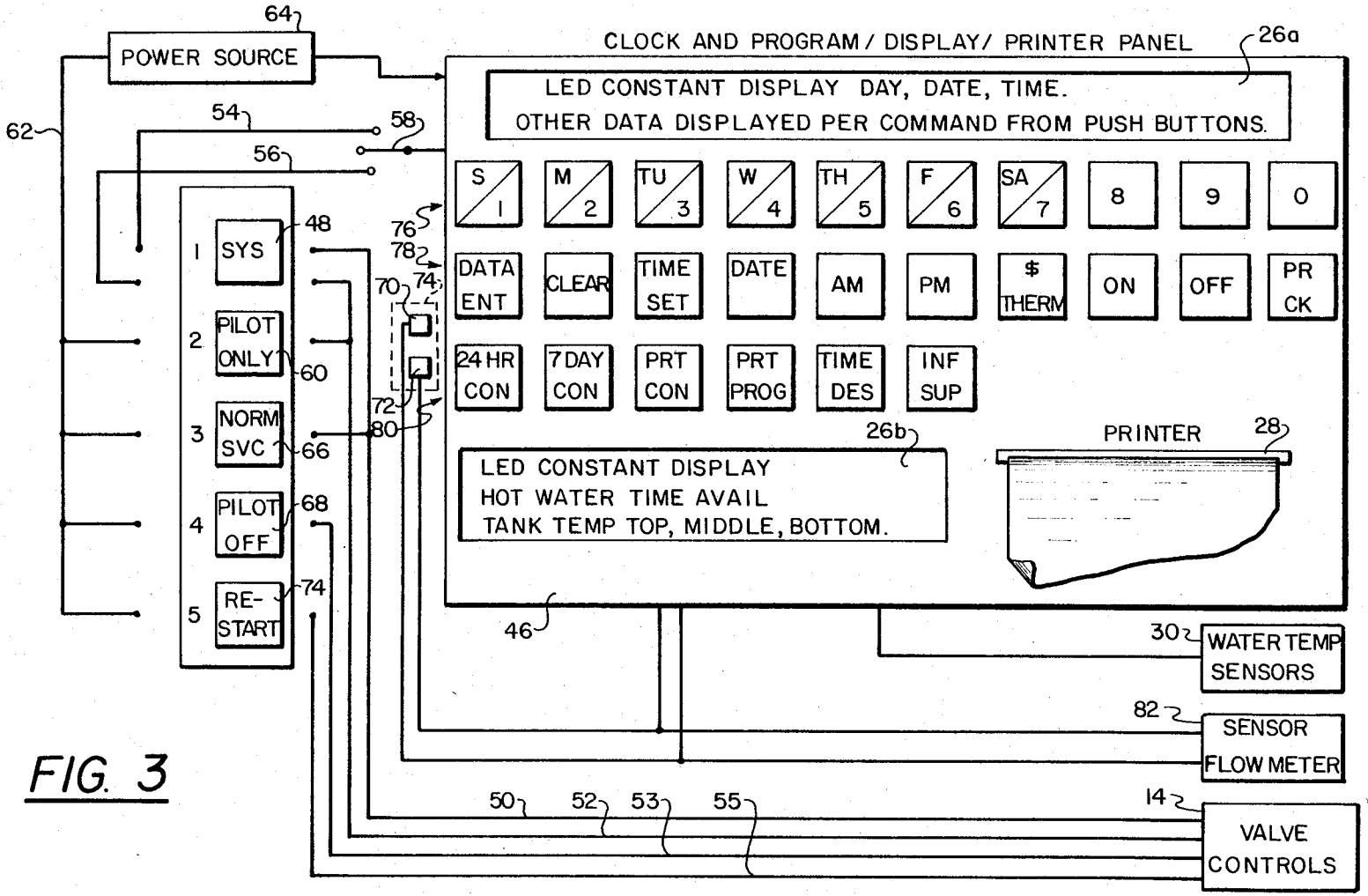
FIG. 3 is a schematic illustration of a wiring diagram and control panel for the present invention.

Turning to FIG. 3, a schematic layout of a control panel and a wiring diagram is illustrated. Turning more particularly to FIG. 3, the basic components of the control system are incorporated preferably in a control housing or panel 46. This is positioned remotely from the water heater itself and as previously discussed, in a convenient location for quick and ready access as well as preferably a visible location for constant reminder of its existence. This panel includes the necessary components as previously discussed. The mode selector 22 is preferably a switch panel incorporated within the control panel and is preferably of the push button type with features as will be more fully explained. This panel, however, is connected in through a wiring harness or cable containing multiple wires for the various electrical signals to be carried between the various components of the system.

The central processing unit is connected through the mode selector to the pilot and burner controls. The central processing or control unit includes a programmer capability which includes a keyboard with a minimum selectable input keys for keying in the programming for the system. The programming keys of the keyboard are essentially self-explanatory with the capability of programming the system for the various functions. The illustrated keyboard includes a first row 76 of 10 buttons for providing data entry of digits from zero through nine with buttons one through seven also in proper sequence providing for entry of the day of the week as indicated. The second row 78 of 10 keys or buttons includes a data entry button which after data is coded into the display and verified as correct, can function to enter this into the processing unit memory. A clear control key is available for cleaning the previous program command in preparation for entering an alternate command or simply deleting the command. Other keys include time, date, AM, PM, on, off and program check.

Time, date and the like are provided for programming into the system as required. The system is provided with the capability also of calculating the cost of the operation of the water system. This is accomplished by programming in the cost per therm of gas which is sensed by the system and calculated and displayed or printed out on the printer as required. Alternate approaches to the calculation may be provided such as cost per gallon of water at specified degrees, etc. This permits a wide variation in the programming of the system to accomplish the maximum savings of energy. The system can also be programmed to display and print supply versus demand figures and recommendations for program adjustment or fine tuning.

The on/off key is used in programming in conjunction with a program check key. After a time is displayed by the LED display for program purposes, the on/off key is depressed to instruct on cycle. On other than initial programming, upon installation, servicing, or power failure, on or off will be automatically entered in the proper sequence after the first command is given. A key for program check will display the next program command in order and subsequent programs as the key is depressed. Date and time of command, as well as command type is displayed. If this key is used, and one of the day buttons row 1 buttons or keys one through seven is used, the first program command of the selected day is displayed and subsequent commands are displayed as the program check key is depressed. A change is initiated by using the clear button to erase a command and then replace it with a new command.

The third row or bank 80 of keys provide a first key which will function to cause display of the therms of gas used and the cost for the past 24 hour period. The seven day consumption key will cause a display of the therms of gas used and the cost in the preceding seven calendar days. A print consumption key after either of the above two buttons functions to print precise detail of energy consumption and cost over the applicable period. The print program functions to print precise detail of the seven day program as well as the analysis of consumption versus need and an indication of needed program modification. A time desired key is provided for an unscheduled demand exceeding the available supply without altering the system program. An "infinite supply" key is provided for an infinite period of conventional operation when desired. An audible sound generator 90 such as a low tone beeper is activated after a certain duration (e.g. 24 hours) when the system is in the infinite supply mode. Normal service switch 66 is depressed for a system override where an unscheduled demand is about to be made. Lower display **26*b* reads "Indicate Time Desired or Infinite Supply." If a given supply of hot water is desired on a one time basis, the time desired switch is depressed. Display 26*b* reads, "Enter Amount of Hot Water Time Desired." The time is entered. The burner is activated and remains on until the time desired is reached. The burner is shut down, normal service switch is raised, and system switch is depressed, all automatically. If, after depressing normal service 66, the consumer desires a normal hot water heater operation until further command, "infinite supply," is depressed. Thereafter, each 24 hours, the low tone beeper 90 sounds and display 26*b*** reads "Depress Infinite Supply if Further Non-Programmed Operation is Desired." Infinite supply is depressed to stop the beeper for another 24 hour period.

The data display for the control unit provides a first window **26*a* for providing a constant display of the date, day, time and other data on command from the keyboard. The data display window 26*b*** provides a constant display of the hot water time available, the tank temperature at top, middle and bottom of the tank. The printer, as explained above, can provide hard copy of certain data as desired.

The mode selector 22 is a switch bank that includes a series of switches for activating certain circuits for selecting the desired mode. The mode selector switch 1 or button 48 functions to close a circuit connecting a circuit to the valve controls 14 by means of a conductor 50 and a conductor 52 through the switch 48 by way of conductors 54 and 56 to the central processing unit which itself controls a selector switch 58 for selecting normal service or pilot on only as programmed into the system.

A pilot only control button 60 operates a switch for connecting line 52 into a circuit including line 62 from a power source 64 such as reduced house hold current or a battery pack, which is used as a backup for the system in case of power failure. This mode button 60 functions to set the system for pilot only operation overriding the system operation which is controlled by the central processing unit and the time controllers. "Pilot Only" avoids full fire-up of the burner per program command. This would be done when the consumer realizes, based on the newly provided ability to control consumption, that the next "burner on" phase is unnecessary. This condition is known by the consumer through reference to the constant LED display of hot water service time then available in the hot water heater. Thus, at a glance, the consumer may realize a shower can be taken or the dishes washed without the programmed cycle coming into effect. This feature may also be used, for example, if the consumer will be away for the evening and will not need the routine evening or morning shower or dishwasher use. The system is set on pilot only by the touch of a button. The program will not turn on the burner until the system is again set in either "system" or "normal service" phases.

A normal service switch activated by a switch button 66 functions to return the hot water control system to its normal operation as it would without the present control system. In other words, it functions to supply water in the conventional manner.

A pilot off control switch operated by control switch or button 68, activates a circuit of conductors 62 and 53 to the pilot valve, and functions to turn the pilot light off to prevent operation of either it or the burner. The condition display panel 24 provides a visual indication of a pilot light "on" condition, such as by an LED light 70 indicating pilot operation. A similar LED display light 72 provides an indication of the burner condition as being on. These may be responsive to a sensor such as a flow meter 82 or a temperature sensing unit as desired.

A pilot start switch or button 74 is provided for completing a circuit 62, 55 for relighting the pilot light from the remote position. This ensures and encourages the consumer to utilize the system (i.e., by turning off the pilot light when not needed because it can be restarted easily). Thus, he may turn off the system by the pilot off switch 68 and, when desired, restart the system with the pilot on switch. Such would be desirable such as when the family is out of town or on vacation for from a few days to a week or more. Commercial users would use this function during holidays or other unexpected periods where hot water is not needed. The switch bank is preferably constructed such that the pilot off button will function to shutdown the pilot and turn off the gas flow to the heater and at the same time lock out buttons 1, 2 and 3, thereby assuring the operator will not attempt system use while the pilot is out. This is backed up by an automatic lockout of these same three buttons, 1, 2 and 3, when the pilot on light is not illuminated. This provides double security in the case the pilot light is extinguished by other than pilot control command.

The lockout of the first three control buttons is released by a successful restart of the system by operation of the buttons 74. Once successfully restarted, button 2 will self-depress and the LED main display will flash a notice reminding the operator to select the desired operation phase.

Turning to FIG. 2, an alternate water heater is shown wherein a heater tank 84 is supplied heat from an electrical heating unit 86 which is controlled by a heater control unit 88. This can be connected into the FIG. 1 control system as explained. The electrical heating unit 86, however, must be selected to have a "low" heat condition in addition to a full heat position. This "low" heat condition will be considered the equivalent of "pilot only" operation of the gas system.

The "pilot only" and "low" heat modes will, in the typical system, be sufficient to raise and maintain the water in the tank at a temperature sufficient to supply hot water to meet normal demand. In other instances it may be necessary to preheat the tank to a predetermined temperature and maintain that temperature by pilot heat for certain demands. The supply of hot water depends upon the temperature of the water in the tank because higher temperature hot water can be mixed with a greater amount of cold water to provide water at a useable temperature. For example, a 40 gallon tank of water at 140° can be mixed with 40 gallons of cold water at approximately 60° to produce about 80 gallons of water at 100°. This system can be easily programmed such that, with the temperature sensors which sense the tank water temperature, which is a known volume and upon being given ambiant or cold water temperature, it can easily calculate from these parameters the available water supply of a selected temperature.

Thus, while I have illustrated and described my invention by means of specific embodiments, it is to be understood that numerous changes and modifications may be made therein without departing from the spirit and scope of the invention as defined in the appended claims.

I claim:

1. A hot water control system, said system comprising:

a water reservoir for containing a predetermined quantity of water, a heat source for heating the water in said reservoir to a predetermined temperature, and control means including programmable means for selectively programming said heat source for heating, at a preselected rate, water contained in said reservoir to a preselected temperature at at least one preselected time to meet demand for a given quantity of heated water during a predetermined peak period of time subsequent to said preselected times and preselected times occurring over a given time interval, and means for sensing the temperature of water in said reservoir, and means for determining, from said temperatures, and the temperature of an available cold water supply, and the capacity of said reservoir, the currently available supply of hot water and, means for visually indicating the currently available supply of hot water of a selected temperature equal to or less than the temperature of said water in said reservoir.

2. The system of claim 1 wherein said time interval is seven days.

3. The system of claim 1 including means for selectively overriding said programmable means.

4. The system of claim 1 including means for determining and visually indicating the currently available supply of hot water.

5. The system of claim 1 including means for computing and displaying the cost of heating the water used over a selected time interval.

6. A hot water control system, said system comprising:

a water reservoir for containing a predetermined quantity of water, a heat source for heating the water in said reservoir to a predetermined temperature, control means including programmable means for selectively programming said heat source for heating, at a preselected rate, water contained in said reservoir to a preselected temperature at at least one preselected time to meet demand for a given quantity of heated water during a predetermined peak period of time subsequent to said preselected time, said preselected times occurring over a given time interval, means for selectively overriding said programmable means, and means for selecting any one of a series of modes consisting of programmable means, normal service, pilot only, and pilot off.

7. The system of claim 6 wherein said programming means includes a central processing unit.

8. The system of claim 7 means for programming said central processing unit for calculating the cost of water used over a selected interval of time; and display means for displaying the calculated costs.

9. The system of claim 8 wherein said display means is a printer.

10. The system of claim 8 wherein said heat source is a gas burner and a pilot light for said burner; and said system further includes remote indicator means for indicating the operative condition of said burner and said pilot light.

11. The system of claim 10 wherein said programmable means is disposed remote from said water reservoir and said source of heat.

12. The system of claim 11 including means for determining and displaying the day of the week, date, and time.

13. The system of claim 12 including means for selectively indicating a programmed condition for a selected day and time.

14. The system of claim 13 including means for constantly displaying amount and temperature of water available.

15. The system of claim 14 including means for relighting the pilot light from said remote location.

16. The system of claim 15 wherein said programmable means includes means for preprogramming a predetermined supply of water for any selected period of time during any selected day of a week.

17. The system of claim 6 wherein said time interval is seven days.

18. The system of claim 6 including means for computing and displaying the cost of heating the water used over a selected time interval.

19. The system of claim 6 including means for sensing the temperature of water in said reservoir, and means for determining, from said temperature and the temperature of an available cold water supply, and the capacity of the reservoir, the currently available supply of hot water of a selected temperature, and means for visibly indicating the currently available supply of hot water of said selected temperature.

* * * * *